US010393133B2

(12) United States Patent
Boehm et al.

(10) Patent No.: US 10,393,133 B2
(45) Date of Patent: Aug. 27, 2019

(54) FLOW-CONDUCTING COMPONENT

(71) Applicant: KSB Aktiengesellschaft, Frankenthal (DE)

(72) Inventors: Alexander Boehm, Frankenthal (DE); Franz Gerhard Bosbach, Frankenthal (DE); Christoph Emde, Frankenthal (DE); Ewald Hoelzel, Frankenthal (DE); Holger Rauner, Frankenthal (DE); Patrick Thome, Frankenthal (DE); Bjoern Will, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 293 days.

(21) Appl. No.: 15/500,710

(22) PCT Filed: Jul. 28, 2015

(86) PCT No.: PCT/EP2015/067235
§ 371 (c)(1),
(2) Date: Jan. 31, 2017

(87) PCT Pub. No.: WO2016/016223
PCT Pub. Date: Feb. 4, 2016

(65) Prior Publication Data

US 2017/0218969 A1 Aug. 3, 2017

(30) Foreign Application Priority Data

Jul. 31, 2014 (DE) ..... 10 2014 215 089

(51) Int. Cl.
*F04D 29/22* (2006.01)
*F04D 29/02* (2006.01)
(Continued)

(52) U.S. Cl.
CPC ..... *F04D 29/2227* (2013.01); *F04D 29/026* (2013.01); *F04D 29/245* (2013.01);
(Continued)

(58) Field of Classification Search
CPC .. F04D 29/2222; F04D 29/245; F04D 29/026; F04D 29/2216; F04D 29/24;
(Continued)

(56) References Cited

U.S. PATENT DOCUMENTS 2,710,580 A * 6/1955 Holzwarth ..... F04D 29/2222 416/186 R
2,766,699 A * 10/1956 Bayless ..... F04D 29/2222 416/186 R
(Continued)

FOREIGN PATENT DOCUMENTS

DE 100 51 954 A1 5/2002
DE 10 2012 106 810 A1 1/2014
(Continued)

OTHER PUBLICATIONS

International Preliminary Report on Patentability (PCT/IB/338 & PCT/IB/373) issued in PCT Application No. PCT/EP2015/067235 dated Feb. 9, 2017, including English translation of document C2 (German-language Written Opinion (PCT/ISA/237)) previously submitted on Jan. 31, 2017 (Nine (9) pages).
(Continued)

*Primary Examiner* — Charles G Freay
(74) *Attorney, Agent, or Firm* — Crowell & Moring LLP

(57) ABSTRACT

A flow-conducting component such as a pump impeller is provided. Passages between vanes of the flow-conducting component include notches in the form of transitions between the vane and a common surface, such as a cover disk. The notches include a transition surface having a geometric configuration determined in accordance with a
(Continued)

calculated load spectrum along at least a portion of the length of the notch and in accordance with a particular geometric pattern.

12 Claims, 2 Drawing Sheets

(51) Int. Cl.
*F04D 29/28* (2006.01)
*F04D 29/24* (2006.01)

(52) U.S. Cl.
CPC ..... *F04D 29/28* (2013.01); *F05D 2230/22* (2013.01); *F05D 2230/31* (2013.01)

(58) Field of Classification Search
CPC ..... F04D 29/38; F04D 29/242; F04D 29/30; F04D 29/388
See application file for complete search history.

(56) References Cited

U.S. PATENT DOCUMENTS

| | | | | |
|---|---|---|---|---|
| 2004/0062636 | A1 | 4/2004 | Mazzola et al. | |
| 2009/0252606 | A1 | 10/2009 | Jahnen | |
| 2012/0189373 | A1 | 7/2012 | Lange | |
| 2015/0125302 | A1 | 5/2015 | Roberto et al. | |
| 2017/0058916 | A1* | 3/2017 | Whitehurst | F04D 29/667 |
| 2018/0142557 | A1* | 5/2018 | Yellapragada | F01D 5/048 |

FOREIGN PATENT DOCUMENTS

| | | | |
|---|---|---|---|
| EP | 1 785 590 | A1 | 5/2007 |
| JP | 2006-226199 | A | 8/2006 |
| JP | 2009-185733 | A | 8/2009 |
| WO | WO 97/39243 | * | 10/1997 |
| WO | WO 2011/003409 | A1 | 1/2011 |
| WO | WO 2013/124314 | A1 | 8/2013 |

OTHER PUBLICATIONS

International Search Report (PCT/ISA/210) issued in PCT Application No. PCT/EP2015/067235 dated Oct. 15, 2015 with English-language translation (seven (7) pages).
German-language Written Opinion (PCT/ISA/237) issued in PCT Application No. PCT/EP2015/067235 dated Oct. 15, 2015 (six (6) pages).
German Search Report issued in counterpart German Application No. 10 2014 215 089.2 dated Jul. 22, 2015 with partial English-language translation (twelve (12) pages).
English translation of Japanese Office Action issued in counterpart Japanese Application No. 2017-503995 dated Mar. 26, 2019 (three (3) pages).

* cited by examiner

FLOW-CONDUCTING COMPONENT

CROSS REFERENCE TO RELATED APPLICATIONS

This application is a National Stage of PCT International Application No. PCT/EP2015/067235, filed Jul. 28, 2015, which claims priority under 35 U.S.C. § 119 from German Patent Application No. 10 2014 215 089.2, filed Jul. 31, 2014, the entire disclosures of which are herein expressly incorporated by reference.

BACKGROUND AND SUMMARY OF THE INVENTION

The present invention relates to the geometric configuration of a flow-conducting component as well as the production of a such component.

Flow-conducting components are known in various embodiments. Depending upon operating conditions, that is to say operating pressure, conveying medium, medium temperature or the like, the component is manufactured from specific materials. The static construction of the housing is likewise greatly dependent upon the field of use.

At sections which are particularly loaded and above all at the transitions between different sections, in particular mechanical stresses can be built up which lead to shortening of the service lives. Stresses can be substantially reduced by an advantageous configuration of the notch, but this necessitates processing of the transition section with tools.

European patent publication no. EP 1 785 590 A1 shows the configuration and production of an impeller of a pump or turbine, wherein attention is focused in particular on the design of the notches. The impeller is welded in a plurality of locations, wherein stresses are directly prevented. During production, the procedure necessitates access to the notches with corresponding tools.

Both casting technology and also joining technology quickly reach the limits for flow-conducting components, since in some instances the notches are accessible only with difficulty and/or are not directly accessible at all from the exterior. This leads to considerable restrictions in the configuration of the geometry of the component.

The object of the invention is to find and to apply, for the mechanical loading at the transition points of a flow-conducting component, especially in the region of the notches, a geometric configuration which can be produced simply and cost-effectively.

The solution provides that the load spectrum of the notch is determined based on calculations, forming the notches geometrically according to their mechanical load, in particular where they are accessible only with difficulty and/or are not directly accessible at all from the exterior.

In this case it is advantageous that the design of the flow-conducting part, which may for example be an impeller for a centrifugal pump, can be free from the restriction of conventional requirements. Limitations due to casting technology and/or joining processes do not have to be taken into consideration, since only the mechanical and hydraulic properties are significant. Such freedom from traditional design principles enables a completely new configuration of the impeller.

In a further embodiment, in the flow-conducting component the notch is configured so that a transition in the component from a first section A to a second section B encloses an angle $\alpha$. The angle bisector of the angle $\alpha$ is ascertained, wherein along this angle bisector a point P is determined. In each case a perpendicular of one of the arms (A, B) forming the angle $\alpha$ passes through the point P. Through the point P a straight line is applied to the respective perpendicular with an angle of 45°, wherein by the intersection of these straight lines with the respective arms (A, B) in each case a distance (S, S') is fixed. The respective centers fix the points Q, Q', wherein at the points Q, Q' in each case straight lines are applied with an angle of 22.5° to the distances S, S', intersecting the arms (A, B) in the points R, R'. The envelope E, E' of this structure predetermines the geometric configuration of the notch.

This simple construction method makes it possible very simply to determine a geometry which in a direction-dependent manner takes into account the differential mechanical load in the component. Impinging forces are analyzed under the effect of the conveyed medium and the operating conditions provided, wherein minimum and maximum values are determined. According to these values the mechanical stability required for the impeller is determined. The method of calculation predetermines the geometric configuration and thus also the use of material and the machining of workpieces.

In an advantageous embodiment the flow-conducting component is produced by a generative process, wherein in particular metal powders are joined to form a component by a beam melting process such as for example laser or electron beam melting. This has the advantage that the impeller can be produced very simply and nevertheless in a very stable manner. Said processes enable the production of fluid-tight components with the possibility of substantial details. In this process a special surface structure can be additionally applied to the components, for example a shark skin which additionally improves the mechanical and hydraulic properties.

In a further advantageous embodiment, in the flow-conducting component at least one notch is arranged in the interior of the component, in particular in a cavity and/or an undercut. This has the advantage that in the geometric configuration of the component locations can be advantageously formed which are not accessible for the mechanical post-processing. This detailed configuration enables the production of components which are mechanically more resilient with a reduced use of material.

In a further embodiment the flow-conducting component is a pump component, in particular of a centrifugal pump. The geometric configuration is advantageous in particular in the case of impellers and/or guide wheels of centrifugal pumps. These parts are subjected to particularly high mechanical loads. The transitions between a guide/impeller vane and a cover disc are sometimes accessible with great difficulty. In a centrifugal pump, in addition to the purely geometric overall structure the surfaces of the individual impeller vanes can of course also be freely configured, so that the boundary layer between the impeller and the fluid can be influenced. In the case of inducers it is also possible inter alia to make components hollow, so that considerable savings of material are possible. The component must then obtain its mechanical stability through the corresponding configuration of the struts inside the hollow spaces, as well as the transitions between mechanically stabilizing sections according to the above design rule.

In a further advantageous embodiment the component is produced from an iron-based material. This enables a simple and cost-effective production on tools which are already ready for mass production. The iron-based material is advantageously an austenitic or martensitic or ferritic or duplex material. This enables the production of corrosion-resistant components. The production of the powders required for the aforementioned high-energy beam processes is likewise cost-effective and simple. This is even more apparent if the iron-based material is advantageously a gray or spheroidal graphite iron material.

Other objects, advantages and novel features of the present invention will become apparent from the following detailed description of one or more preferred embodiments when considered in conjunction with the accompanying drawings.

DETAILED DESCRIPTION

Figure 1:
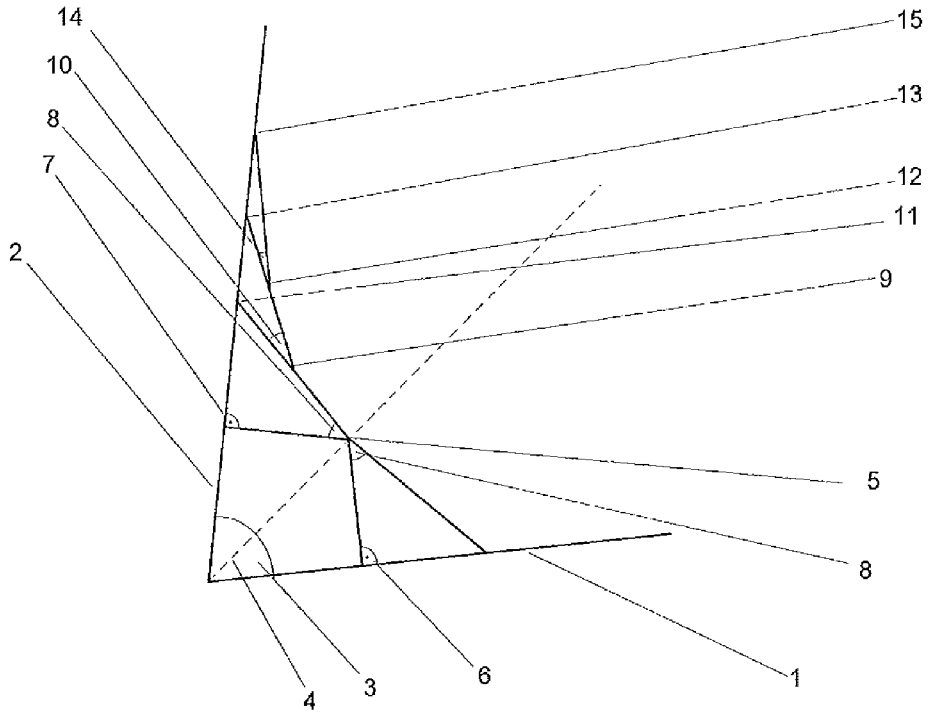
FIG. 1 illustrates geometric relationships of a flow-conducting component in accordance with the present invention.

FIG. 1 shows an arbitrary location at which the contour of a component transitions from a first zone 1 discontinuously into a second zone 2, wherein the two sections enclose an angle 3. At this point of discontinuity considerable stresses develop which can be influenced significantly by a suitably designed geometric configuration. In the case of a predefined breaking point the stresses can be used in order to allow the component to break in a targeted manner at the point of discontinuity under a threshold load. Usually, however, the opposite is desirable, and the point of discontinuity should be sufficiently resilient against the applied forces. A so-called engineer's notch is traditionally provided here which shapes the sharp angle by a curve with a chosen radius.

With reference to various observations in nature, a method for designing the notch has been developed which is simple to construct and nevertheless absorbs the forces at the point of discontinuity so that the loads of the component can be very considerably reduced with minimal expenditure on design and manufacture. In this connection an angle bisector 4 is defined through the angle 3. A point 5 is selected on this angle bisector 4. Through this point 5 the straight lines 6 and 7 are placed perpendicular to the sections 1 and 2. With respect to these straight lines 6 and 7, at the point 5 straight lines which intersect the sections 1 and 2 are applied at the angle 8 of 45°, wherein the intersection point 11 is fixed in the section 2. The distance between the point 5 and the point 11 is halved, so that the point 9 is obtained, at which a straight line is applied at the angle 10 of 22.5° and intersects the section 2 at point 13. The distance between the point 9 and the point 5 is again halved, so that the point 12 is obtained, at which a straight line is applied at the angle 14 of 12.2° and intersects the section 2 at point 15. The envelope of this structure produces a contour which has different points of discontinuity. This would be rather disadvantageous for machining. In a generative production method, where the workpiece is produced by linking together individual volume elements or material layers, operating in discrete units, such a structure can be ideally implemented in a workpiece.

The presented structure is based upon a non-symmetrical loading of a component. If the component were symmetrically loaded, for example by alternating left/right running, then the structure can be supplemented symmetrically in the direction of the first section 1 in an analogous manner.

Figure 2A:
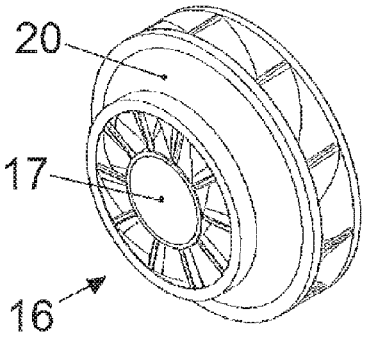
FIGS. 2A, 2B illustrate oblique views of a flow-conducting component in accordance with an embodiment of the present invention.
Figure 2B:
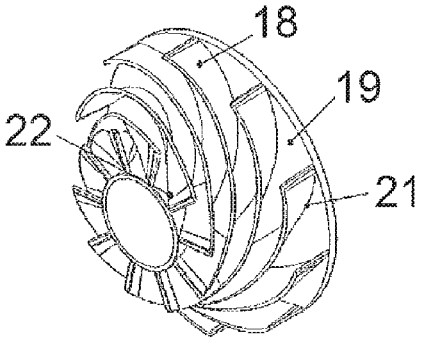

FIGS. 2A, 2B show an example of an application for the method of construction and production according to the invention. In FIG. 2*a* an impeller 16 is illustrated, such as is used for example in a centrifugal pump. The impeller 16 has a hub region 17 and a cover disc 20. Further details can be seen from FIG. 2*b*. The impeller vanes 18 and a further cover disc can be seen here. Such an impeller with the two cover discs 20 and 19 is designated as a closed impeller. Both in the region of the impeller hub 17 and also in the region of the cover discs 19 and 20, in each case the impeller vanes 18 have transitions 21 and 22 which correspond to the ones described in FIG. 1. In the region of the cover disc 19 the transition 21 can be described so that the surface of the cover disc 19 constitutes the first section 1 and the impeller 16 constitutes the second section 2. The forces occurring at the point of discontinuity between the two sections 1 and 2 can be the determined from the parameters of the impeller, the liquid of the pump and the application. With reference to these forces the point 5 is fixed in the notch to be constructed. The notch is constructed with this point. If the impeller 16 is produced for example in a 3D printing process, the contours of the transitions 21 and 22 can be produced at each location on the impeller with the precision of the resolution of the printing process, without any post-processing being necessary. This particularly advantageous contour, which could not be produced with corresponding accuracy of shape by conventional cutting processes, can be constructed even at locations which could not even be reached with tools for post-processing, which initially is not directly apparent from FIG. 2.

The presented construction and production principle links the effect of a generic 3D printing production method, which operates in principle with separate elements in which individual voxels or layers on a workpiece are joined, with a method for optimizing a discontinuous surface geometry. As a result it is possible to omit a further post-processing of the workpiece, in which the individual layers of the production must be "smoothed" to give a continuous body.

The application in the illustrated closed impeller already shows the advantages in the production and the potential for saving material with careful design. Particularly advantageously, the method according to the invention can be applied in an interior which is no longer accessible at all from the exterior after production.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SIGNS

1 first section
2 second section
3 angle
4 angle bisector
5 point
6 right angle
7 right angle
8 angle of 45°
9 point
10 angle of 22.5°
11 intersection point
12 point
13 point

14 angle of 12.25°
15 point
16 impeller
17 impeller hub
18 impeller vanes
19 cover disc
20 cover disc
21 transition
22 transition

The invention claimed is:

1. A flow-conducting component, comprising:

a cover disk; and a plurality of vanes arranged on the cover disk circumferentially about a component rotation axis, wherein a plurality of notches are delimited in regions adjacent to intersections of the plurality of vanes with the cover disk, each of the plurality of notches adjacent to a respective vane of the plurality of vanes contains material configured to couple the respective vane to the cover disk, at least a portion of each of the plurality of notches is geometrically configured in accordance with a mechanical load spectrum calculation of material stresses at the intersection of the respective vane and the cover disk, the geometrical configuration including a minimum thickness of each of the plurality of notches from a point of intersection of the respective vane and the cover disk, the minimum thickness being based on the calculated material stresses at each of the plurality of notches and on a predetermined maximum allowable stress in the material at each of the plurality of notches, each of the plurality of notches is configured such that at any distance along at least a portion of a length of each of the plurality of notches from the cover disk and vane intersection, a transition from a first section of each vane to a second section of the cover disk encloses a first angle, a first line perpendicular to the first section extends from the first section to a point on a bisecting line of the first angle, a second line at a 45° angle to the first line extends from the point on the bisecting line to the first section, the 45° angle being located on a side of the first line away from an intersection of the first and section sections, a third line at a 22.5° angle to the second line extends from a midpoint of the second line to the first section, the 22.5° angle being located on a side of the second line away from the intersection of the first and section sections, a surface of the transition follows the second and third lines, and the point on the bisecting line located at a distance from the intersection of the first and second sections is the minimum thickness, such that the geometric configuration of the transition has sufficient structural strength to withstand the calculated mechanical load spectrum.

2. The flow-conducting component according to claim 1, wherein a material of the flow-conducting component is at least one metal powder joined by beam melting.

3. The flow-conducting component according to claim 1, wherein at least one notch is arranged in at least one of a cavity and an undercut in an interior of the component.

4. The flow-conducting component according to claim 1, wherein the component is a centrifugal pump component.

5. The flow-conducting component according to claim 4, wherein the component is a centrifugal pump impeller.

6. The flow-conducting component according to claim 1, wherein the component is an inducer.

7. The flow-conducting component according to claim 1, wherein a material of the component is an iron-based material.

8. The flow-conducting component according to claim 7, wherein the iron-based material is one of an austenitic, a martensitic, a ferritic or a duplex material.

9. The flow-conducting component according to claim 7, wherein the iron-based material is one of a gray or spheroidal graphite iron material.

10. The flow-conducting component according to claim 1, wherein the surface of the transition is further defined by one or more additional lines extending to the first section from a midpoint of the proceeding line at an angle that is one-half of the angle defining preceding line.

11. A method for producing a flow-conducting component having an impeller cover disk and a plurality of impeller vanes arranged on the cover disk circumferentially about an impeller rotation axis, the flow-conducting component having notches delimited in regions adjacent to intersections of the plurality of vanes with the cover disk, each of the notches adjacent to a respective vane of the plurality of vanes containing material configured to couple the respective vane to the cover disk, comprising the steps of:

calculating a mechanical load spectrum of material stresses at the intersection of the respective vane and the cover disk;

determining a geometric configuration of each notch, the geometric configuration of the notch at any location along a portion of a length of the notch being defined by a minimum thickness of each of the notches from a point of intersection of the respective vane and the cover disk, the minimum thickness being based on the calculated material stresses at each notch and on a predetermined maximum allowable stress in the material at each notch, and at any distance along at least a portion of the length of each notch from the cover disk and vane intersection, a transition from a first section of each vane to a second section of the cover disk which encloses a first angle, a first line perpendicular to the first section extending from the first section to a point on a bisecting line of the first angle, a second line at a 45° angle to the first line extending from the point on the bisecting line to the first section, the 45° angle being located on a side of the first line away from an intersection of the first and section sections, a third line at a 22.5° angle to the second line extending from a midpoint of the second line to the first section, the 22.5° angle being located on a side of the second line away from the intersection of the first and section sections, a surface of the transition which follows the second and third lines, and the point on the bisecting line is located at a distance from the intersection of the first and second sections is the minimum thickness, such that the geometric configuration of the transition has sufficient structural strength to withstand the calculated mechanical load spectrum; and forming the component by a generative process in which particles of at least one metal powder are fused together by beam melting.

12. The method according to claim 11, wherein the beam melting is performed with at least one of laser and electron beam melting.

* * * * *